United States Patent [19]

Jacuzzi

[11] 4,034,428

[45] July 12, 1977

[54] ADJUSTABLE DRAIN CONTROL ASSEMBLY

[75] Inventor: Roy A. Jacuzzi, Moraga, Calif.

[73] Assignee: Jacuzzi Research, Inc., Berkeley, Calif.

[21] Appl. No.: 544,223

[22] Filed: Jan. 27, 1975

[51] Int. Cl.[2] ..... A47K 1/14

[52] U.S. Cl. ..... 4/287; 29/213 E; 210/166; 251/352

[58] Field of Search ..... 4/191, 190, 286, 287, 4/208, 197, 189, 198, 288, 292, 295; 251/341, 144, 352; 137/625.31; 29/213 E, 217, 218, 234, 237, 240; 210/163–166

[56] References Cited

U.S. PATENT DOCUMENTS

| | | | |
|---|---|---|---|
| 1,963,202 | 6/1934 | Hume | 29/240 X |
| 2,166,273 | 7/1939 | Ulmer | 210/164 X |
| 3,110,323 | 11/1963 | Helguera | 137/625.31 |
| 3,357,561 | 12/1967 | Schmid et al. | 210/163 |
| 3,469,699 | 9/1969 | Blendermann et al. | 210/166 |

*Primary Examiner*—Richard E. Aegerter
*Assistant Examiner*—Stuart S. Levy

[57] ABSTRACT

The invention involves an adjustable drain control assembly for a bathtub or the like, comprising a cylindrical component having both end and side openings exposable within the tub when installed, and having a total flow capacity of the order of that of said cylindrical component, and a cap rotatably installed over such openings, the cap having corresponding end and side openings adapted to be simultaneously aligned with the end and side openings in the cylinder component, to permit of maximum drainage flow through the drain control assembly.

2 Claims, 7 Drawing Figures

ADJUSTABLE DRAIN CONTROL ASSEMBLY

The invention relates to bath and hydromassage tubs and more particularly to a drain control for such a tub.

Convention type drain controls usually involve a drain plug adapted to be elevated for drain purposes, from a remote control built into an end wall of the tub. Such type drain controls are restricted as to flow capacity provided in full open position, and for a large tub, as is usually available for hydromassage use, this means relatively slow emptying.

The objects of the present invention are:

1. to provide a novel and improved drain control assembly;

2. to provide a novel and improved drain control assembly, which eliminates remote control mechanism of the conventional drain control;

3. to provide a novel and improved drain control assembly providing larger than conventional drain capacity;

4. to provide a novel and improved drain control assembly providing maximum flow capacity approximating flow capacity of the piping to which it may be coupled;

4. to provide a novel and improved drain control assembly of simplified design and one which is readily installable;

6. to provide a novel and improved installation tool for the aforementioned drain control assembly.

Additional objects of my invention will be brought out in the following description of a preferred embodiment of the invention, taken in conjunction with the accompanying drawings, wherein FIG. 1 is a view partly in section, of the drain control assembly of the present invention, taken in the planes 1—1 of FIG. 2;

Figure 5:
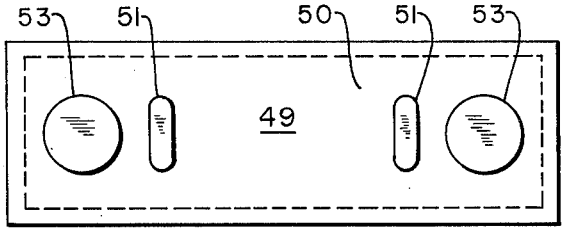
FIG. 5 is a bottom plan view of an installation tool employable in the installation of the drain control assembly of FIG. 1.
Figure 6:
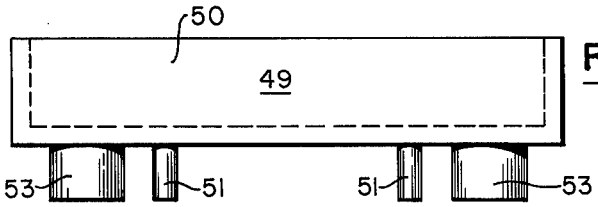
FIG. 6 is a side view of the tool of FIG. 5.
Figure 7:
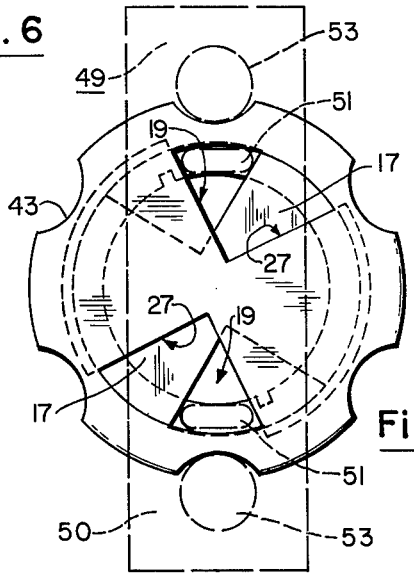
FIG. 7 is a view depicting the manner of employing the tool of FIGS. 5 and 6 in the installationof the drain control assembly of FIG. 1.
Figure 1:
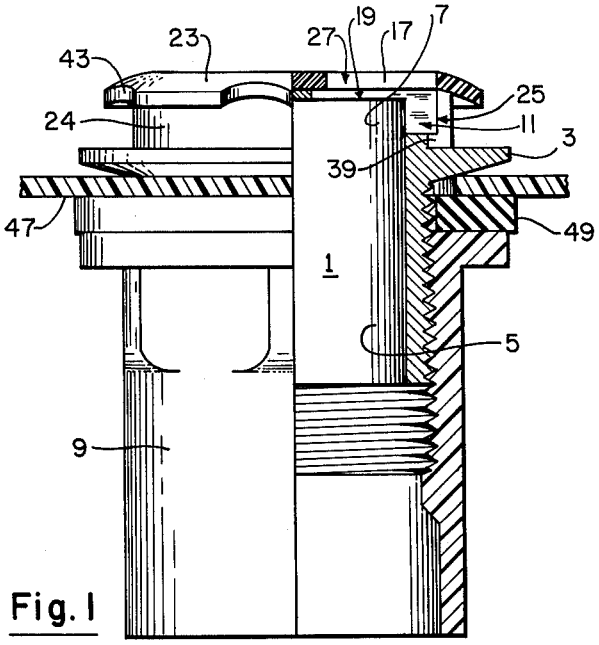
Figure 4:
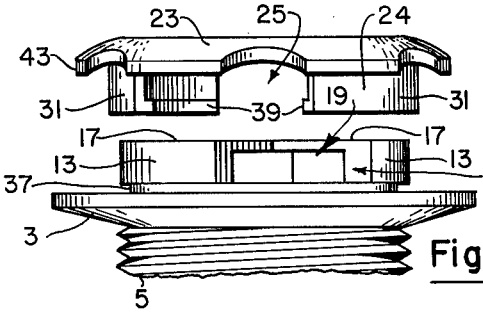
FIG. 4 is an exploded view depicting more details of the device of FIG. 1.
Figure 2:
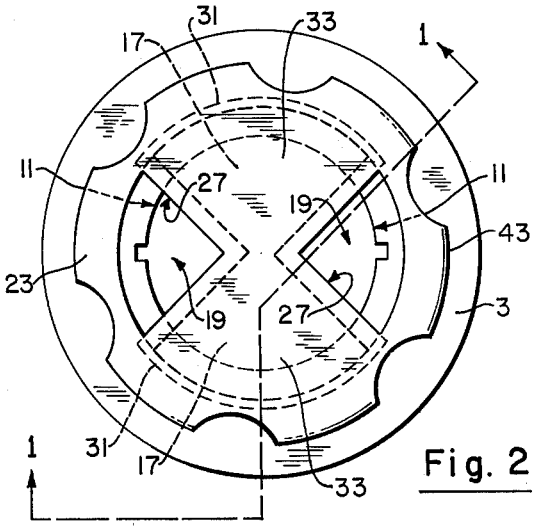
FIG. 2 is a top plan view of the device of FIG. 1, depicting it in fully open condition.

Referring to the drawings the drain control assembly of the present invention involves a hollow cylindrical component 1 having an intermediate external flange 3 in proximity to one end, to divide the component into a long section 5 and a short section 7.

The long section is preferably externally threaded for installation in a drain fitting 9 which would be coupled to a drain pipe (not shown). The fitting 9 may be of plastic where plastic piping is used.

The short section 7 has substantially equally spaced peripheral notches 11 in the edge thereof, leaving intervening peripheral ridges 13.

Radial triangular shaped segments 17, which may be formed integrally with the hollow cylindrical component 1, extend from the peripheral ridges to merge at the longitudinal axis of the cylindrical component to define radial triangular shaped openings 19 between them, each in line with a peripheral notch opening 11, to provide enlarged passageways into the cylindrical component, the total flow capacity of such passageways approximating, if not exceeding the flow capacity of the cylindrical component itself.

A control cap 23 is rotatably fitted over the end of the short section 7, to control exposure of these enlarged passageways, whereby such passageways may be fully exposed or fully closed, at the option of the user.

Figure 3:
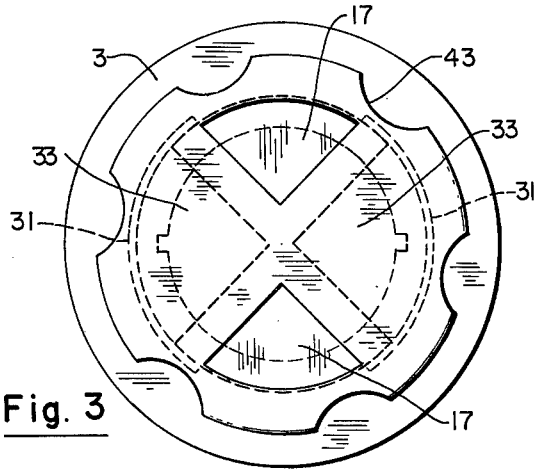
FIG. 3 is a top plan view of the device of FIG. 1, depicting it in fully closed condition.

Such cap may be of plastic, and formed with a depending cylindrical flange 24 surrounding the notched rim in sliding relationship thereto, the cap, inclusive of its cylindrical depending flange, having openings 25 and 27 corresponding to openings 11 amd 19 respectfully, with intermediate segments 31 and 33 of sufficient area to block out such openings 11 and 19 respectively, when the cap is adjusted to bring these areas into blocking position as depicted in FIG. 3.

To rotatably secure the cap in place, the short section 7 of the cylindrical component, adjacent the flange 3, is undercut or so cast as to provide a channel 37, while the cap is molded with a complimentary inturned lip 39 adapted to snap into the channel to lock the cap is position, while permitting rotation thereof to effect control of the passageways into the cylindrical component. Such control is facilitated by including in the forming of the cap, an overhanging scalloped flange 43 to provide for a firm manual grip of the cap in effecting adjustment.

In installing the above described drain control assembly, the tub 47, in the floor of which it is to be installed, is placed over the fitting 9 with its drain opening in alignment with the fitting, a sealing gasket 49 being first placed in position between the fitting and the tub. The drain control is then threaded into the fitting sufficiently tight to effect a sealing at the gasket.

To facilitate such installation, a special tool in the form of a wrench 49 may be provided. This involves a rectangular handle 50 having a pair of depending substantially rectangular studs 51, spaced and shaped to fit into such notches 11 as may be located diametrically opposite each other. When so inserted and turned, these studs will engage and bear against the proximate ends of peripheral ridges 13, where maximum force may be applied by the wrench without danger of damage to the device. By reverse operation, the tool may be employed to remove the assembly, if desired.

A cylindrical stud 53 adjacent each end of the handle is adapted to fit into a scallop of the cap and turn the cap along with the cylindrical component when installing or removing the drain assembly.

From the foregoing description of the invention in its preferred form, it will be apparent that the same fulfills the objects thereof, and while the description has been that of the invention in its preferred form, the same is subject to alteration and modification without departing from the underlying principles thereof and I accordingly do not desire to be limited in my protection to the details illustrated and described except as may be necessitated by the appended claims.

I claim:

1. An adjustable drain control assembly comprising a hollow cylindrical component having an external flange in proximity to one end thereof to divide said component into a long section and a short section, said short section having peripheral notches in the edge thereof, leaving intervening peripheral ridges, segments extending from said peripheral ridges and merging to define openings between them which, with the peripheral notches in the edge of said short section, establish enlarged passageways into said cylindrical component having a total flow capacity of the order of that of said cylindrical component, a cap spanning the end of said shorter section and including a cylindrical flange surrounding said notched rim in sliding relationship thereto, said cap inclusive of its cylindrical flange, having openings simultaneously alignable with the openings forming said enlarged passageways, and means rotatably securing said cap in its position over the end of said shorter section, said means for rotatably securing said cap over the end of such shorter section including a peripheral channel formed externally in the notched edge of said shorter section and an inwardly directed flange on said cap meshing with said channel in slidable relationship with the walls thereof.

2. An adjustable drain control assembly comprising a hollow cylindrical component having an external flange in proximity to one end thereof to divide said component into a long section and a short section, said short section having spaced peripheral notches in the edge thereof, leaving intervening peripheral ridges, segments extending from said peripheral ridges and merging to define openings between them which, with the peripheral notches in the edge of said short section, establish enlarged passageways into said cylindrical components having a total flow capacity of the order of that of said cylindrical component, a cap spanning the end of said shorter section and including a cylindrical flange surrounding said notched rim in sliding relationship thereto, said cap inclusive of its cylindrical flange, having openings simultaneously alignable with the openings forming said enlarged passageways, means rotatably securing said cap in its position over the end of said shorter section, and means for installing said drain control assembly in a tub drain, said means for installing said drain control in a tub drain, including a thread on the long section of said cylindrical component, and a tool comprising a bar having a pair of depending stubs spaced apart a distance equal to the internal diameter of said cylindrical component and adapted to pass through openings in said cap and into notch openings in the edge of said shorter section, whereby said tool stubs will engage end wall areas of proximate ridges upon rotation of said tool and thus facilitate screwing or unscrewing of said drain control into or out of a drain fitting.

* * * * *